US005088730A

United States Patent [19]

Appleton

[11] Patent Number: 5,088,730

[45] Date of Patent: Feb. 18, 1992

[54] SWING WITH LOWER SUPPORT STRUCTURE

[76] Inventor: Richard E. Appleton, 303 S. 9th St., Midlothian, Tex. 76065

[21] Appl. No.: 581,808

[22] Filed: Sep. 13, 1990

[51] Int. Cl.[5] ..... A63G 9/16

[52] U.S. Cl. ..... 272/85; 272/97; 297/277; 297/278; 297/279

[58] Field of Search ..... 272/85-92; 297/273, 276-282, 255, 440

[56] References Cited

U.S. PATENT DOCUMENTS

| | | | |
|---|---|---|---|
| 155,739 | 10/1814 | McAdams | 297/277 |
| 295,275 | 3/1884 | Oaks | 297/277 |
| 1,189,393 | 7/1916 | Shaw | 297/277 X |
| 4,799,669 | 1/1989 | Appleton | 272/85 |

*Primary Examiner*—Richard E. Chilcot, Jr.

*Attorney, Agent, or Firm*—James C. Fails

[57] ABSTRACT

A balanced, tiltable swing swingingly suspended from a low support structure and above a lower support characterized by main body portion having longitudinally extending framework with laterally disposed lathes and defining a seat, a foot support connected with the main body portion and extending downwardly such that the foot support will contact the lower support when the swing is tilted forwardly; the main tilt beam traversing laterally of the swing and supported at each end by respective chains; respective auxiliary chains connected with the back of the seat and with the respective springs connected intermediate the chains to control the force required to tilt the seat; with the degree of tilt of a given swing being contained to a maximum.

With the low support structure, the swing can be employed almost anywhere.

7 Claims, 1 Drawing Sheet

SWING WITH LOWER SUPPORT STRUCTURE

FIELD OF THE INVENTION

This invention relates to swings; and more particularly, to suspended swings such as porch or patio swings, for supporting one or more occupants from a support structure such that the occupants can swing themselves in the swing in which they sit.

DESCRIPTION OF THE PRIOR ART

The prior art has seen the development of a wide variety of approaches to body support means that can be swung. These have ranged from hammocks through rope swings supported outdoors, to porch swings for being supported on porches, or verandas. Illustrative of the type of swings are those found in the following:

The closest art of which I am aware is my own earlier issued patent U.S. Pat. No. 4,799,669. That patent describes a tiltable swing that is balanced over a balance beam, similarly as is this invention. This application includes by reference the material in that patent and references cited thereagainst if any such information be omitted herefrom.

Additional art was found through searches and earlier filings and include the following U.S. Patents:

- U.S. Pat. No. 424,329, Messmore, discloses a convertible hammock and chair suspended from a hook by ropes through a loop 11 such that the occupant could lean backwardly or support himself in a more nearly sitting position.
- U.S. Pat. No. 465,017, Eller, discloses a swinging chair in which the back of the chair is supported by way of a swing so as to enable a balancing or reclining motion to be experienced by the occupant, such as a child in the swing.
- U.S. Pat. No. 953,591, Bringham, discloses an adjustable swinging chair in which a back is suspended from an arm 16 that is connected, as by eye 20, with a suspending rope or the like.
- U.S. Pat. No. 1,061,462, Foster, discloses a swing seat in which the seat is suspended from a pair of ropes 6 and has a detachable swing seat with lower foot rests for a child or the like.
- U.S. Pat. No. 1,189,393, Shaw, discloses a swing supported by front and back ropes over respective pulleys and having a stop at the top such that the movement of the rope over the pulley can be stopped whenever a desired degree of tilt has been achieved. Individual chairs are disclosed.
- U.S. Pat. No. 1,192,941, Schmid, discloses a swing with a shaped body support formed by structural members and lathes running longitudinally of the swing. The front and back supports are connected with chain which is connected with a main link supported from a single chain which is supported from a single eye hook at each end of the swing.
- U.S. Pat. No. 1,240,089, Pottinger, discloses a swing suspended from a platform or the like and having an adjustable center support 5 where the height of a swing seat can be adjusted. By way of a pivotable connection, the back can swivel about its pivot connection and the foot rest can be swiveled forwardly about its pivot connection. The seat and back are also pivotally connected together as is the seat and leg support portion.
- U.S. Pat. No. 1,538,601, Talbert, discloses a porch swing having bifurcated chain supported within a loop of a main support chain and with springs on the back chains to provide a means for varying the character of any vibratory movement.

- U.S. Pat. No. 1,689,397, Lee, discloses a porch swing attachment having springs at the front and rear of arm rest members to accommodate vibratory motion in addition to swinging from a cable 6 or the like.
- U.S. Pat. No. 2,520,377, Schrougham, discloses a swing seat in which respective supports 39, 41 at each end remain in a bifurcated element 36 connected with a suspended swing seat. Overhead support railings are defined in the outdoor swing of this invention.
- U.S. Pat. No. 4,221,429, Wade, discloses a suspended recliner having leg supports that can be tilted into or out of position and forming a reclining hammock-like structure suspended from a single ring 48.

From the foregoing, it can be seen that the prior art has failed to provide a balanced, tiltable porch swing having low support and having a main body providing seats for one or more occupants and providing a balance wherein the swing can be tilted forwardly so that a foot rest would encompass a main support such as a floor to facilitate ingress and egress from the swing in which the swing can be tilted backward to lift the foot support from the floor and be gently swung at the frequency desired by the occupant by a simple movement of the head, yet can be readily swung forwardly again if desired.

SUMMARY OF THE INVENTION

Accordingly, it is an object of this invention to provide a balanced, tiltable swing that is suspended and can be tilted forwardly to facilitate ingress and egress; yet, can be tilted either forwardly or backwardly at the convenience and desire of the occupants and easily swung at the desired frequency; and have the requisite low support structure to be able to be placed anywhere at the convenience of the occupant.

It is a specific object of this invention to provide a swing having a main body portion defining a seat that can be tilted forwardly to contact a foot support with the floor or the like and be tilted forwardly or backwardly as desired by the occupant; yet, has a low support structure and can be swung easily by simple movement of the head once the swing is suspended tilted with the foot rest raised out of contact with the floor.

These and other objects will become apparent from the descriptive matter hereinafter, particularly when taken in conjunction with the appended drawings.

In accordance with one embodiment of this invention, there is provided a balanced, tiltable swing suspended from a support structure and above a lower support characterized by a main body portion having laterally extending lath members for defining a seat, a foot support connected with the main body portion and extended downwardly such that the foot support will contact the lower support when the swing is tilted forwardly; the main tilt beam traversing laterally of the swing and supported at each end by respective chains; respective auxiliary chains connected with the back of the main body portion and the seat and a spring connected with at least one of the chains at each end and connected with the main body portion of the swing to control the force required to tilt the seat and a safety allowing a maximum degree of tilt for a given swing and load.

DESCRIPTION OF PREFERRED EMBODIMENT(S)

Figure 2:
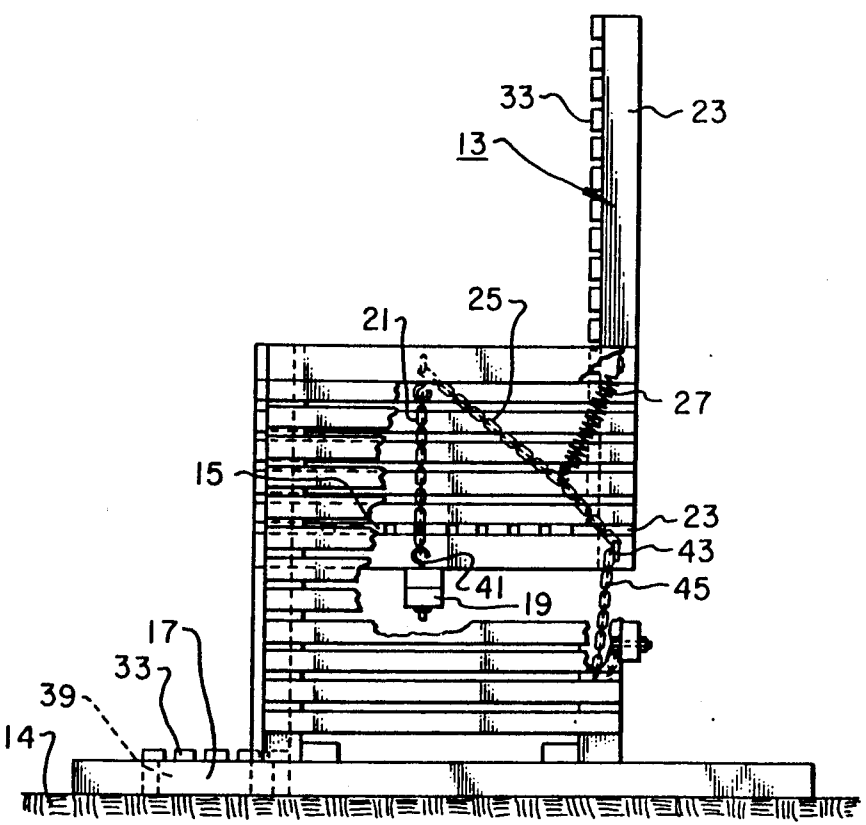
FIG. 2 is a side elevational view of the swing of FIG. 1.
Figure 1:
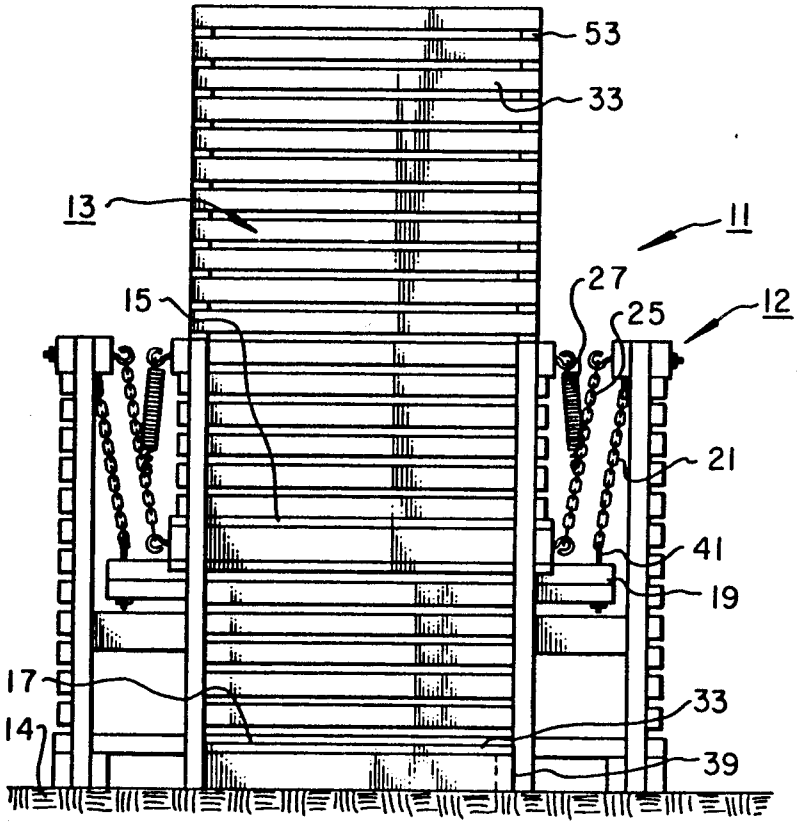
FIG. 1 is a front elevational view of a swing in accordance with one embodiment of this invention.

Referring to FIGS. 1 and 2, the swing 11 is illustrated. The swing 11 is a balanced tiltable swing that is swingingly suspended from a support structure 12. Specifically, the swing is balanced for tilting about a main tilt beam 19.

The swing 11 comprises a main body portion 13 having a seat 15 for supporting at least one person or occupant. Preferably, if desired, more than one person can be seated in the swing simply by making a more elongate swing 11. A more elongate swing was included in U.S. Pat. No. 4,799,669 and that possibility is included herein by reference. The swing 11 also comprises a foot support 17 that extends downwardly such that the foot support can come in contact with a lower support such as a floor 14, when the swing is tilted forwardly. The swing 11 also comprises a main tilt beam 19 traversing laterally of the main body portion 13, as illustrated. Thus it can be seen that the main tilt beam 19 serves as a pivotal beam supporting the swing 11 and disposed near the center of gravity of the swing 11 with the swing 11 substantially balanced thereover and such that the swing can be tilted forwardly or backwardly with respect to the beam with very little unbalancing force. Expressed otherwise, the weight of the swing forward of the beam 19 is substantially equal to the weight rearwardly of the beam 19, although it may be slightly greater such that the foot support can come to rest on the lower support 14. By "very little force" as little as ten pounds placed at the rear of the seat of the swing can unbalance the swing to cause it to tilt rearwardly, or about the beam 19, and raise the foot support 17 from the lower support 14. In this way, when a person sits in the swing with the extra weight of the person rearwardly of the beam, the swing will be tilted rearwardly to lift the foot support 17 from the lower support 14. Thereafter, the swing can be swung forwardly or rearwardly merely by nodding of the head of the occupant.

The swing 11 also includes a plurality of main lineal supporting members 21, FIG. 2, with at least one lineal support member 21 being disposed at each end of the main tilt beam 19. As also illustrated in FIG. 1, the main lineal support members 21 are connected with the upper support and the main tilt beam 19.

The swing 11 also includes a structural framework 23, FIGS. 1 and 2. The structural framework 23 is connected with the seat portion 15 and disposed a predetermined distance above the seat portion so that at least shoulder height support, or about 20 inches, is provided. The structural framework 23 provides a strong support for connecting with auxiliary lineal supporting members, directly or by way of intermediate portion of the main lineal member 21. For example, the structural framework 23 may comprise the desired length of 2 inch×4 inch, 4 inch×4 inch, or any suitable structural member desired. As illustrated, the structural framework 23 has a plurality of substantially vertical members along each side, having a plurality of lath members 33 traversing intermediate and being fixedly connected to the vertical support members, as by nailing. The term "vertical" support members is used herein to mean substantially vertical when operationally hung in the correct position as illustrated in FIGS. 1 and 2. The structural framework may have desired cross bracing or the like as needed. In the illustrated embodiment, the desired support may be provided directly by the desired width and thickness of the wood members and the connected lath members 33. While nailing is given by way of example, any other suitable means of fastening can be employed. For example, there may be employed notches, lag screws or the like if desired. Ordinarily, nailing provides adequate structural support.

The swing 11 also includes auxiliary lineal support members 25, FIG. 2, disposed at least one at each end of the main beam 19, and connected to the back of the swing. As illustrated, the auxiliary support members 25 are connected with respectively the main lineal support 12 and with the bottom rear of the seat 15.

The swing 11 also includes a biasing means 27 that is connected with the auxiliary support member about 4 links up as shown in FIG. 2 and with the intersection of the arm rest and the back structural support 23. As illustrated, the biasing member 27 is connected about four links up from the bottom right of the auxiliary lineal member 25 and forms a slight deformation which causes the desired result. If desired, even more deformation and a stronger force could be effected for seating multiple persons, as in a double swing. The slight displacement of the auxiliary member, or chain, 25, causes the foot rest 17 to be displaced toward the floor 14. The exact reason why and how this works is not completely understood and no theory is given for the reason for the efficacy of this invention.

The biasing means 27 was connected at other places and could not be made to work as in the parent case.

The seat 15 is illustrated as a flat seat. It could be made arcuate if desired but the expense and trouble to make it arcuate does not appear to be worthwhile since a flat surface serves the purpose exceptionally well. As illustrated, the seat 15 is formed of wood and is formed of the structural framework and the lath members depicted and delineated herein if desired; however, other material such as aluminum could be fabricated to form the respective elements delineated.

With this embodiment in which a single swing is preferred, no canopy is employed, although it can be employed if desired. Particularly, if multiple swings are employed, or a swing for multiple persons or occupants the canopy may be desirable. It is felt, however, that with a low support structure such as illustrated herein, there is no need for a large super structure such as that afforded by a canopy.

The foot support 17 may comprise structural members that protrude such as beams 39 and longitudinal extending lathes 33. It is relatively immaterial whether the lathes be thought of as extending laterally or longitudinally as long as the direction is clear. Specifically, they extend across the width of the chair portion of the swing in the illustrated embodiment. This can be thought of as extending longitudinally of the swing if an elongate swing is provided, as for multiplicity of occupants. On the other hand, it is, perhaps, easier to think of the lathes as being lateral wherein single occupant swing is illustrated or described, as can be seen in FIGS. 1 and 2.

The foot support 17 and its main support member 39 may comprise two inch thick by 4 inch wide hardwood as described. Since the foot support will rest on the bottom support, such as a floor, it does not require a great deal of structural strength.

The main balance beam 19, on the other hand, will bear most of the weight of the occupants of the swing so it should be structurally substantial and strong. Expressed otherwise, it should measure the desired length and about 4 inches×4 inches in width and thickness as formed by two beams 2 inch×4 inch wide affixed together or a central 4 inch×4 inch beam. As illustrated, the main tilt beam 19 contains in each end extending beyond the seat 15, eye bolts 41, for affixing a chain or nailing a supporting member thereto. As is recognized, an eye bolt is simply a bolt with an eye at the top and having a fastening means; such as, a lag screw or nut with or without washers on the other end after being inserted through the beam through a suitable aperture such as a drilled aperture extending through the tilt beam 19.

The main lineal supporting members 21 may comprise chain, cable, rope or the like as desired. As illustrated, they comprise a main chain that has one of its links connected with the eye bolt 41. Of course, the means of interconnection with the eye bolt will be appropriate to the type of main lineal supporting member employed. In the illustrated embodiment where the main lineal member is a chain, the link may be simply interconnected with the eye. On the other hand, a cable may be doubled back and fastened to itself, a rope may be tied or doubled back and fastened to itself.

The top end of the main lineal support member 21 is connected with a support such as a beam of the support structure, or the like. The connection may be as desired; for example, by eye bolts or by being looped over the beam and fastened.

The auxiliary lineal support members may comprise any of the suitable members such as chain, cable, rope or the like. As illustrated, each auxiliary lineal support member comprises a second chain 25 that has its link connected with an eye bolt 43 and the back beam 23 of the seat 15. The back connection member may be part of the structural framework 23. The eye bolt 43 may be an eye bolt, per se, or it may be an eye on a lag screw as desired. In any event, it should be adequate to maintain the stress to which it is subjected.

In like manner, if cable or rope are connected as the auxiliary supporting members, they are suitably fastened as discussed hereinbefore. In the illustrated embodiment, the other end of the auxiliary chain 25 is connected with the rear beam, as by eye bolts or the like with the biasing means 27 connected intermediate, or about 4 links up from the bottom rear of the chair portion of the swing 11. As illustrated, the back support beam 23 is fixed in its relationship with the others and does not move relative to the other parts of the swing. It is fixed in this particular position because of the degree of the tilt and to assure proper clearance of the foot rest above the floor.

A safety 45 prevents too much tilt.

The illustrated interconnection of the biasing means 27 and the auxiliary chain 25 afford proper tension for the chain so that the swing will react with a given weight upon tilting of the swing.

The spring forms part of the biasing means 27, is important also in maintaining the resilience. As illustrated, the biasing means 27 is a linear, or lineal spring. As noted hereinbefore, the lineal spring is connected about 4 links above the connection of the auxiliary support means with the back of the seat and forms a slight deformation of the auxiliary lineal support member 25 to give the desired tilt; yet, allow the foot rest to come in contact with the floor 14. In the illustrated embodiment, the spring is a ten inch spring having a wire size of 0.07 inch with outside diameter of 0.812 inch and available from the Raymond Merchandise Division of Barns Group, Inc., Corry, Pa. 16407. The force of the biasing means may be varied, as well as the varying of the points of connection with respect to the chair and the auxiliary lineal support member to control the force required to tilt the swing rearwardly by an occupant and to lift the foot support 17 off the floor in which it rests, following egress of an occupant, and to control the degree of tilt of the swing with a given load.

In operation, the swing will be tilted forward as illustrated in FIG. 2 and an occupant can simply step on the foot support 17 and sit on the seat 15. The act of seating, and particularly when the occupant leans backward, or rearwardly, creates an unbalanced force sufficient to lift the foot rest 17 from the lower support 14. This causes the foot rest 17 to lift free of the floor and the occupant or occupants can then swing simply by moving their respective head or heads forwardly and rearwardly at the desired frequency. At this time if the occupant or occupants desire to leave the swing, the one or more occupants simply can lean forwardly. This causes the foot support 17 to come in contact with the floor 14 and stop the swing, facilitating egress by the one or more occupants.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

I claim:

1. A balanced, tiltable swing suspended from a support structure and above a lower support, comprising:

a. a main body portion having a seat portion for supporting at least one person;

b. a foot support portion connected with said main body portion such that said foot support portion will contact the lower support when the swing is tilted forwardly;

c. a main tilt beam traversing laterally of said main body portion and disposed near the center of gravity of said main body portion with said main body portion substantially balanced thereover when unoccupied and operationally hung and such that said main body portion can be tilted forwardly and backwardly with little unbalancing force;

d. a plurality of main lineal support members with at least one main lineal support member being disposed at each end of said main tilt beam, said respective main lineal support members being respectively connected with the support structure;

e. a back support means connected with said main body portion, including a back beam, and extending a predetermined distance above said seat portion;

f. a plurality of auxiliary lineal supporting members, disposed at least one at each end of said main body portion; connected with respective said lineal support members and with said back support means;

g. a biasing means connected with at least said auxiliary support lineal member for controlling the force required to tilt said swing backwardly by an occupant person in the degree of tilt; and h. a safety tilt limit connected with said swing for preventing tilting beyond a predetermined degree of tilt;

such that an occupant person can step on a said foot rest and be seated in said main body portion, tilt said main body portion backwardly easily and swing by simple oscillating movement of the head at the proper frequency.

2. The claim of claim 1 wherein said main lineal support members comprise respective chains at each end of said swing, the support structure comprises a support means including a beam that is supported from a low support, and the lower support comprises a floor.

3. The swing of claim 2 wherein said main lineal support members and said auxiliary support members each comprise respective chains, at least one each at each end of said back support means and said main tilt beam has respective eye bolts for being connected with respective links of at least said main lineal support chain; wherein said biasing means is a spring and said spring is connected with said main lineal support and said auxiliary support chains and is connected with said back support means of said swing.

4. The swing of claim 1 wherein said main body portion, including said seat, include a structural framework extending longitudinally thereof and having laterally disposed lathes therealong.

5. The swing of claim 1 wherein said main body portion has arm rests and wherein the support structure comprises a low support that extends to about the same height as said arm rests.

6. The swing of claim 1 wherein said main body portion is designed to fit only on person.

7. The swing of claim 1 wherein said main body portion comprises armrests connected with both said seat means and said back support means; said main lineal support member and said auxiliary support member comprise chains with at least one link connected with a spring forming said biasing means, the other end of said spring, being a lineal spring, being connected with the intersection of said arm rest and said back support means.

* * * * *